US011060822B2

(12) United States Patent
Kazemi

(10) Patent No.: US 11,060,822 B2
(45) **Date of Patent: *Jul. 13, 2021**

(54) ACTIVE MULTI-SPECTRAL SYSTEM FOR GENERATING CAMOUFLAGE OR OTHER RADIATING PATTERNS FROM OBJECTS IN AN INFRARED SCENE

(71) Applicant: Raytheon Company, Waltham, MA (US)

(72) Inventor: Hooman Kazemi, Thousand Oaks, CA (US)

(73) Assignee: Raytheon Company, Waltham, MA (US)

( * ) Notice: Subject to any disclaimer, the term of this patent is extended or adjusted under 35 U.S.C. 154(b) by 6 days.

This patent is subject to a terminal disclaimer.

(21) Appl. No.: 16/792,683

(22) Filed: Feb. 17, 2020

(65) Prior Publication Data

US 2020/0333113 A1 Oct. 22, 2020

Related U.S. Application Data

(63) Continuation of application No. 16/021,669, filed on Jun. 28, 2018, now Pat. No. 10,563,958.

(60) Provisional application No. 62/531,429, filed on Jul. 12, 2017.

(51) Int. Cl.
*F41H 11/02* (2006.01)
*F41H 3/00* (2006.01)

(52) U.S. Cl.
CPC ..... *F41H 3/00* (2013.01); *F41H 11/02* (2013.01)

(58) Field of Classification Search
CPC ..... F41H 3/00; F41H 11/02
See application file for complete search history.

(56) References Cited

U.S. PATENT DOCUMENTS

| | | | |
|---|---|---|---|
| 4,142,015 | A | 2/1979 | Bienz |
| 5,077,101 | A | 12/1991 | Conway et al. |
| 5,281,460 | A | 1/1994 | Cox |
| H1522 | H | 4/1996 | Campillo et al. |

(Continued)

OTHER PUBLICATIONS

International Search Report and Written Opinion of the International Searching Authority dated Sep. 21, 2018 in connection with International Patent Application No. PCT/US2018/039983, 11 pages.

(Continued)

*Primary Examiner* — Eliza W Osenbaugh-Stewart

(57) ABSTRACT

An apparatus includes at least one transmitter configured to transmit wireless signals that create different localized heating in different portions of a scene. The different localized heating in the different portions of the scene is based on different moisture or liquid content within objects in the scene. The apparatus also includes at least one controller configured to control the at least one transmitter in order to control the different localized heating in the different portions of the scene and to create a desired thermal radiation pattern in the scene. The desired thermal radiation pattern in the scene may include a camouflage pattern that increases clutter in an infrared image, at least one temporary infrared marker, or at least one false shape in an infrared image. The desired thermal radiation pattern could reduce a contrast between a cold infrared background in the scene and one or more targets in the scene.

20 Claims, 5 Drawing Sheets

(56) References Cited

U.S. PATENT DOCUMENTS

| | | | | |
|---|---|---|---|---|
| 5,703,314 | A | 12/1997 | Meeker | |
| 5,734,495 | A | 3/1998 | Friedman | |
| 5,949,081 | A | 9/1999 | Ashley et al. | |
| 6,127,007 | A | 10/2000 | Cox et al. | |
| 7,132,635 | B2 | 11/2006 | Dowling | |
| 7,199,344 | B2 | 4/2007 | Blake | |
| 7,795,583 | B1 | 9/2010 | Hubbard et al. | |
| 7,832,018 | B2 | 11/2010 | Schwarz | |
| 8,077,071 | B2 | 12/2011 | Cincotti et al. | |
| 9,175,930 | B1 | 11/2015 | Pezeshkian et al. | |
| 10,563,958 | B2 * | 2/2020 | Kazemi | F41H 3/00 |
| 2014/0355085 | A1 | 12/2014 | Woida-O'Brien et al. | |

OTHER PUBLICATIONS

"Adaptiv—A unique camouflage system", BAE Systems, Dec. 2016, 7 pages.

Johnson, "Army Greatest Inventions 2011 Winners: M992 40mm IR cartridge, 5.56mm M855A1 & M240L", The Firearm Blog, Sep. 2011, 11 pages.

Communication pursuant to Article 94(3) EPC dated Sep. 29, 2020 in connection with European Patent Application No. 18743274.5, 6 pages.

* cited by examiner

400

500

ACTIVE MULTI-SPECTRAL SYSTEM FOR GENERATING CAMOUFLAGE OR OTHER RADIATING PATTERNS FROM OBJECTS IN AN INFRARED SCENE

CROSS-REFERENCE TO RELATED APPLICATIONS AND PRIORITY CLAIM

This application claims priority under 35 U.S.C. § 120 as a continuation of U.S. patent application Ser. No. 16/021,669 filed on Jun. 28, 2018 (now U.S. Pat. No. 10,563,958), which claims priority under 35 U.S.C. § 119(e) to U.S. Provisional Patent Application No. 62/531,429 filed on Jul. 12, 2017. These applications are hereby incorporated by reference in their entirety.

TECHNICAL FIELD

This disclosure generally relates to infrared detection systems. More specifically, this disclosure relates to an active multi-spectral system for generating camouflage or other radiating patterns from objects in an infrared scene.

BACKGROUND

Infrared cameras are widely available from a number of sources and are routinely used to provide security or perform other functions at night and in other low-light situations. Conventional infrared cameras typically generate images in which the background is darker in color, and people, animals, or heated objects appear much brighter in the images than the darker background. "Infrared camouflage" attempts to mask the presence of people, animals, or heated objects in infrared images so that they appear darker in color and are harder to distinguish from the background in the infrared images. Among other things, infrared camouflage could be used to help protect military or law enforcement personnel from being easily detected in dangerous environments.

Some conventional attempts to provide infrared camouflage are based on covering a person in a thermal suit formed from material that reduces his or her thermal signature. However, requiring a person to wear a thermal suit often reduces the person's flexibility of movement. Also, since there is little thermal discharge from the thermal suit, the person's body temperature can rise to uncomfortable or dangerous levels. In addition, the reflectivity of the thermal suit often increases when the thermal suit gets wet, which can lead to easier detection.

Other conventional attempts to provide infrared camouflage for vehicles or other objects involve the use of heating or cooling plates that are mounted directly on the objects. The temperatures of the plates can be changed adaptively to camouflage the objects against the background. However, these approaches require the use of heavy plates and are therefore bulky and costly. These approaches can also be difficult to implement successfully and are often dedicated to specific vehicles or systems.

SUMMARY

This disclosure provides an active multi-spectral system for generating camouflage or other radiating patterns from objects in an infrared scene.

In a first embodiment, an apparatus includes at least one transmitter configured to transmit wireless signals that create different localized heating in different portions of a scene. The different localized heating in the different portions of the scene is based on different moisture or liquid content within objects in the scene. The apparatus also includes at least one controller configured to control the at least one transmitter in order to control the different localized heating in the different portions of the scene and to create a desired thermal radiation pattern in the scene.

In a second embodiment, a method includes, using at least one transmitter, transmitting wireless signals that create different localized heating in different portions of a scene. The different localized heating in the different portions of the scene is based on different moisture or liquid content within objects in the scene. The method also includes controlling the at least one transmitter in order to control the different localized heating in the different portions of the scene and to create a desired thermal radiation pattern in the scene.

In a third embodiment, a non-transitory computer readable medium contains instructions that when executed cause at least one processing device to initiate transmission, by at least one transmitter, of wireless signals that create different localized heating in different portions of a scene. The different localized heating in the different portions of the scene is based on different moisture or liquid content within objects in the scene. The medium also contains instructions that when executed cause the at least one processing device to control the at least one transmitter in order to control the different localized heating in the different portions of the scene and to create a desired thermal radiation pattern in the scene.

Other technical features may be readily apparent to one skilled in the art from the following figures, descriptions, and claims.

BRIEF DESCRIPTION OF THE DRAWINGS

For a more complete understanding of this disclosure, reference is made to the following description, taken in conjunction with the accompanying drawings, in which.

DETAILED DESCRIPTION

Figure 1:
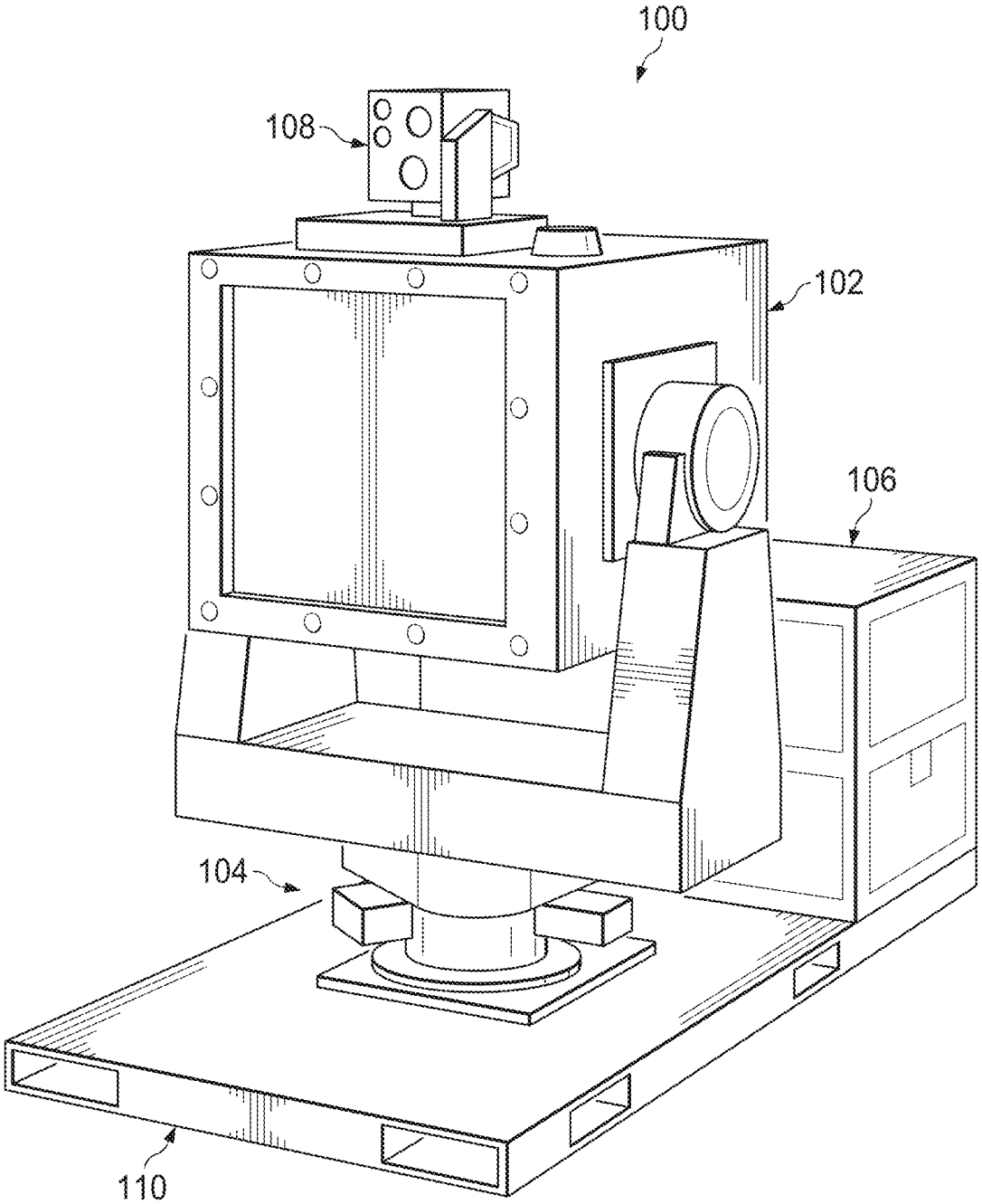
FIG. 1 illustrates an example active multi-spectral system for generating camouflage or other radiating patterns in a scene in accordance with this disclosure.

FIGS. 1 through 6, described below, and the various embodiments used to describe the principles of the present invention in this patent document are by way of illustration only and should not be construed in any way to limit the scope of the invention. Those skilled in the art will understand that the principles of the present invention may be implemented in any type of suitably arranged device or system.

As noted above, various attempts have been made to provide infrared camouflage but have suffered from various shortcomings. Among other reasons, this is because the conventional approaches described above attempt to match the infrared temperature of a person, animal, or heated object to the much cooler background. The person, animal, or heated object is typically hundreds of degrees hotter than a background's cold temperature in the infrared spectrum. It is therefore very difficult to completely mask the thermal presence of a person, animal, or heated object in infrared images.

This disclosure provides techniques for reducing the contrast between a cold background in an infrared scene and one or more targets. For example, these techniques can reduce the contrast of a night dark background in the infrared multi-spectrum band compared to a higher-temperature human body, animal body, or heated object. This is achieved by raising the temperature of objects, such as plants, rocks, and dirt, in the scene. Rather than trying to hide one or more targets within infrared images, these techniques increase the temperature of the objects so that the objects radiate thermal energy. As a result of these thermal emissions by the objects, it becomes more difficult to discern people, animals, or objects in the infrared images. An "infrared scene" or "scene" generally refers to an area that may be monitored by an infrared camera or other infrared detector. A "target" generally refers to a person, animal, or object that is to be hidden or camouflaged from an infrared camera or other infrared detector.

To implement these techniques, at least one transmitter (such as in an active denial system) is used to heat objects in an infrared scene so that the objects radiate thermal energy in a desired manner. For example, the plants, rocks, dirt, or other components within a background can be heated to different levels so that those components radiate thermal energy in a camouflage pattern or other pattern (such as one that includes faux shapes) to help provide concealment or camouflage in the infrared images. Since the radiation of thermal energy substantially reduces the contrast between the background and one or more targets, it increases the "scene clutter" in infrared images. Random, semi-random, or other patterns can be created in infrared images, which make it very difficult for an onlooker to use an infrared camera or other infrared detector. If the camouflage pattern has the same general appearance as the people, animals, or objects being camouflaged, these techniques could be used to actually imitate the appearance of those people, animals, or objects in multiple areas.

The camouflage pattern(s) generated using these techniques could be static or dynamic. Dynamic patterns could be useful, for example, when masking the movements of one or more people, animals, or objects. The camouflage pattern(s) could also be based on actual or expected infrared characteristics of the people, animals, or objects to be obscured or concealed. For instance, obscuring or concealing one or more people may involve a camouflage pattern having smaller areas that are brighter than the background, while obscuring or concealing a vehicle may involve a pattern having larger areas that are even brighter. It is also possible for one or more camouflage patterns to be created naturally, such as when different objects absorb the transmitter energy in different amounts, which causes those objects to be heated differently. This might be all that is needed to create broken background images, even when using a constant transmission pattern by the transmitter.

Overall, this helps to reduce the effectiveness of many infrared cameras and provide multi-spectral camouflage. These techniques can therefore reduce or eliminate the need for camouflage thermal suits, bulky heating or cooling plates, or other camouflage components. This may allow, for example, military or law enforcement personnel to engage in more effective or safer night or other low-light operations. These techniques could find use in a large number of environments and applications, including in tactical and fixed facility applications.

Note that while often described below as being used for camouflage, the same or similar techniques described in this patent document could be used for other purposes. For example, these techniques could be used to create temporary infrared markers in specified environments, such as during tactical operations. As a particular example, these techniques could be used to create infrared "breadcrumbs" to highlight where people or objects should travel at night or in other low-light situations. As another example, these techniques could be used as part of infrared scene projection systems in order to test infrared imagers, infrared seekers, or infrared missiles. As yet another example, these techniques could be used to provide static and dynamic virtual scenes for integration and testing tasks involving infrared devices. As still another example, these techniques could be used to provide "friend or foe" detection by allowing the creation of identification numbers, codes, or other information in a background. As a final example, these techniques could be used to support communication with or between hidden personnel, such as those personnel hidden in vegetation. Of course, other uses of these techniques are also possible.

FIG. 1 illustrates an example active multi-spectral system 100 for generating camouflage or other radiating patterns in a scene in accordance with this disclosure. The embodiment of the active multi-spectral system 100 shown in FIG. 1 is for illustration only. Other embodiments of the active multi-spectral system 100 could be used without departing from the scope of this disclosure.

Figure 2:
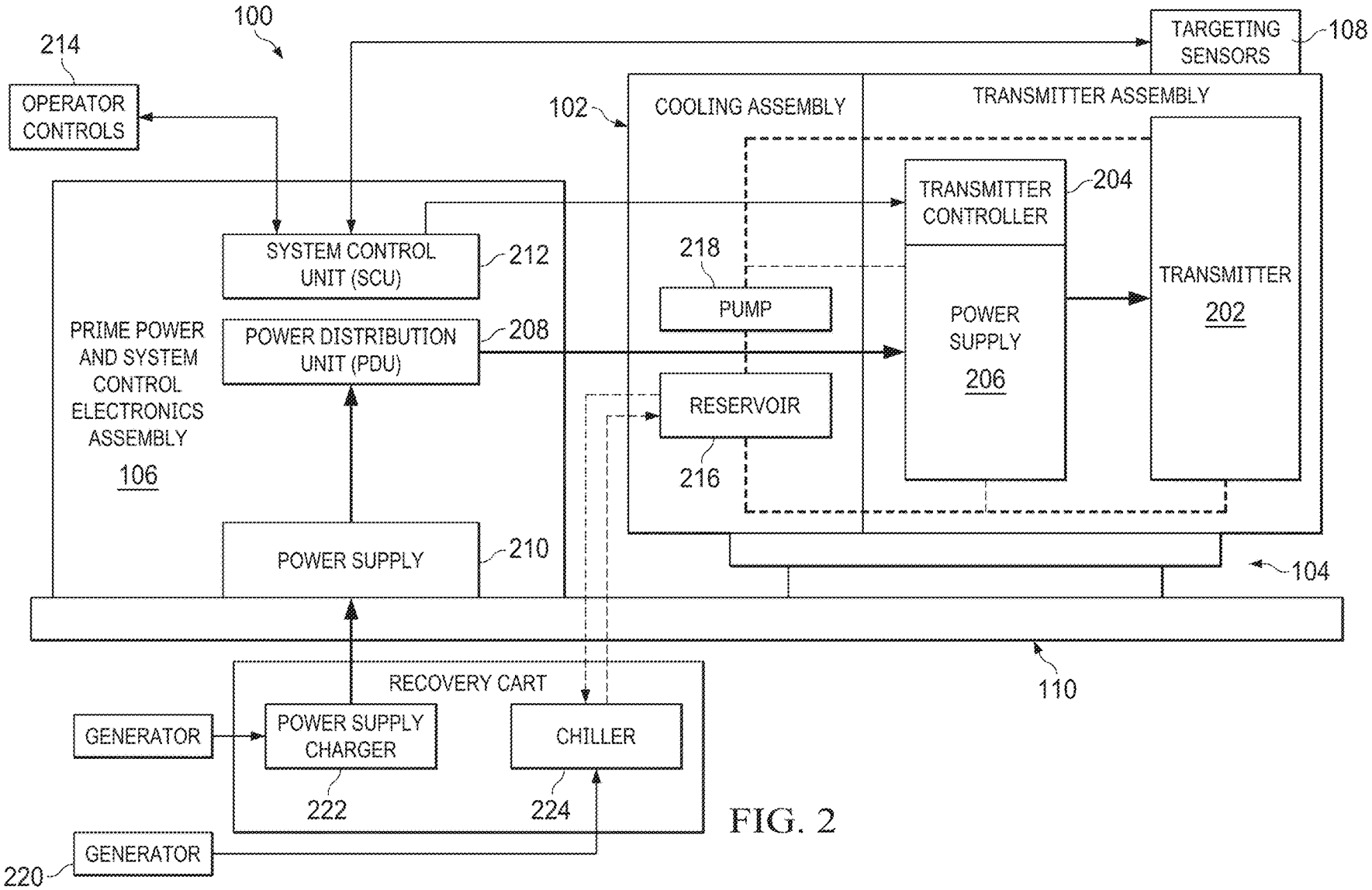
FIG. 2 illustrates example components of an active multi-spectral system for generating camouflage or other radiating patterns in a scene in accordance with this disclosure.

As shown in FIG. 1, the system 100 includes an elevation payload assembly 102, a gimbal 104, an electronics assembly 106, one or more targeting sensors 108, and a support platform 110. The payload assembly 102 generally includes a transmitter assembly that generates and transmits microwave, millimeter wave (mmW), terahertz (THz), high-energy laser (HEL), or other wireless signals. The wireless signals heat objects in one or more areas and cause the objects to radiate thermal energy, thereby creating thermal emissions from the objects in a random, semi-random, or other pattern. Thus, the wireless signals are used to create one or more thermally radiating patterns from the objects in the one or more areas. The payload assembly 102 can also include a cooling assembly for cooling the transmitter assembly. The payload assembly 102 includes any suitable structure for generating wireless signals used to create thermal emissions from objects in one or more areas. An example implementation of the payload assembly 102 is shown in FIG. 2, which is described below.

The payload assembly 102 is mounted on or to the gimbal 104, and the gimbal 104 is used to aim the payload assembly 102. For example, the gimbal 104 could rotate the payload assembly 102 both horizontally (such as about an azimuth axis) and vertically (such as about an elevation axis) to aim the payload assembly 102 in a desired direction. The gimbal 104 includes any suitable structure for rotating or otherwise moving a payload.

The electronics assembly 106 includes components used to control the operation of the payload assembly 102. For example, the electronics assembly 106 could control whether the transmitters in the payload assembly 102 are transmitting wireless signals. The electronics assembly 106 could also control the transmitters in the payload assembly 102 so that the transmitters produce specific wireless signals that generate a desired thermal radiation pattern from desired objects in one or more areas. Any suitable pattern(s) in the transmissions of the wireless signals can be used, including random, semi-random, or constant transmissions of the wireless signals in different directions. The electronics assembly 106 includes any suitable structure for controlling the operation of one or more transmitters. An example implementation of the electronics assembly 106 is shown in FIG. 2, which is described below.

The one or more targeting sensors 108 can be used by an operator to locate specific targets or areas and to aim the payload assembly 102. For example, information from one or more targeting sensors 108 could be presented to an operator on a display, and the operator could use a joystick or other control device to cause rotation/elevation of the payload assembly 102. This allows the operator to direct where the wireless signals from the payload assembly 102 are transmitted. Each targeting sensor 108 includes any suitable structure for identifying an area or target. Example types of targeting sensors 108 include visible cameras, infrared cameras, and laser rangefinders.

The support platform 110 denotes a structure on or to which the gimbal 104 is mounted. In this example, the support platform 110 represents a pallet with slots for fingers of a forklift, which may allow for easy transport of the system 100. However, the support platform 110 could denote any other suitable fixed or movable structure on or to which other components of the system 100 could be mounted, such as a ground vehicle, a flight vehicle, a marine vessel, or a building.

In some embodiments, the payload assembly 102, gimbal 104, electronics assembly 106, and targeting sensor(s) 108 are arranged in a package that is small enough to be installed on various platforms without requiring a dedicated vehicle for use. For example, the package could be suitable for use as an add-on component to armored transport vehicles, ships, airplanes, or other military or law enforcement vehicles. In particular embodiments, the system 100 could be similar in size to the Common Remotely Operated Weapon Station (CROWS). Note that in this example, the payload assembly 102, gimbal 104, electronics assembly 106, and targeting sensor(s) 108 are all positioned on the support platform 110, which may be useful or necessary during transport. However, once installed on a vehicle, vessel, building, or other structure, the electronics assembly 106 could be positioned elsewhere (such as inside the structure) and need not be positioned behind the payload assembly 102.

In particular embodiments, the system 100 can be implemented using a modified version of the FORECHECK system developed by RAYTHEON COMPANY. The FORECHECK system is used for standoff explosive detection, meaning the system operates to detect explosive devices at a distance, which can help in the identification of improvised explosive devices (IEDs) or other explosive devices. The FORECHECK system uses a high-power millimeter wave transmitter and a high-resolution infrared camera to illuminate and view one or more targets in order to detect hidden explosive devices. Such a system can be modified to support the generation of high-power millimeter wave signals or other wireless signals that heat objects and create thermal emissions from the objects in order to generate camouflage or other radiating patterns from objects in an infrared scene. Of course, other embodiments of the system 100 could also be used.

During operation, the system 100 is used to control the emissivity of a background in order to generate desired camouflage or other patterns in the thermal radiation emitted by the background. This is accomplished through temporal and spatial directed-energy radiation that is transmitted towards the background from the payload assembly 102. In some cases, this creates thermal emissions from various objects in a scene, which reduce the contrast between one or more targets and the background when viewed through an infrared camera or other infrared detector through blackbody radiation. In other cases, this creates thermal emissions from various objects, which allow temporary markers or other infrared indicators that are viewable through an infrared camera or other infrared detector to be generated.

Depending on the implementation, the system 100 can allow various functions to be performed. For example, the system 100 can cause generation of multi-spectral camouflage that results from directed energy being absorbed by the background and re-radiated as blackbody radiation visible across multiple wavelengths. The background can be illuminated to provide one or more targets with counter-shading, counter-illumination, motion camouflage, disruptive coloration, and/or multi-scale camouflage. This active camouflage technique can enable long-lasting camouflage through thermal absorption and re-radiation and enhanced effects through dissipative natural scene features (such as when objects with high and low water content absorb differently). It is also possible that this active camouflage technique can be used to enhance the radiation contrast of plants by enabling plant alarm triggers to be initiated through the use of directed energy. The system 100 can also be used to create one or more decoys in infrared images by creating thermal radiation in one or more desired shapes at one or more standoff distances to an onlooker. The system 100 can further be used to create hidden paths through a terrain using directed energy illumination of path markers that are visible in the infrared spectrum. In addition, the system 100 could be used to detect someone wearing a camouflage suit by focusing directed energy onto a given area in order to increase the contrast of that area and highlight anomalies for rapid detection.

In addition to being able to support or provide these functions, the system 100 can provide various other benefits or advantages depending on the implementation. For example, the system 100 can be used to create adaptive camouflage in a much more rapid manner than conventional adaptive camouflage techniques (such as those using heating or cooling plates). Also, conventional systems may be able to create camouflage that is effective only in a narrow field of view, while the system 100 can be used to create camouflage that is not dependent on look-angle. Further, the system 100 can be less complex and have smaller size, weight, power, and cost (SWAP-C) compared to conventional systems. Moreover, the system 100 is less sensitive to motion under camouflage, meaning people, animals, or objects can move within an infrared scene while being camouflaged more effectively. In addition, the system 100 enables "system transportability and scalability," meaning the same concept could apply to multiple targets in an infrared scene, such as multiple humans or vehicles.

Although FIG. 1 illustrates one example of an active multi-spectral system 100 for generating camouflage or other radiating patterns in a scene, various changes may be made to FIG. 1. For example, the form factor of the system 100 shown in FIG. 1 is for illustration only, and the system 100 could be implemented in any other suitable manner.

FIG. 2 illustrates example components of an active multi-spectral system 100 for generating camouflage or other radiating patterns in a scene in accordance with this disclosure. The embodiments of the components of the active multi-spectral system 100 shown in FIG. 2 are for illustration only. Other embodiments of the components of the active multi-spectral system 100 could be used without departing from the scope of this disclosure.

As shown in FIG. 2, the payload assembly 102 in this example includes at least one transmitter 202, which generates the wireless signals used to heat objects and create thermal radiation from the objects. In some embodiments, the transmitter 202 is implemented using an array of smaller transmitters. Any suitable transmitter(s) 202 could be used to generate wireless signals for heating objects and creating thermal radiation from the objects as described in this patent document. Example types of transmitters 202 include one or more high-resolution millimeter wave, microwave, terahertz, or high-energy laser sources.

The transmitter 202 can generally operate to transmit wireless signals that create desired thermal radiation without causing excessive heating of people, animals, or objects that are being masked. The transmitter 202 is also typically associated with array amplifiers and other radio frequency (RF) components. In some embodiments, multiple monolithic microwave integrated circuit (MIMIC) gallium nitride (GaN) power amplifiers or other power amplifiers can be grouped into multiple sub-modules. The sub-modules can be grouped together to form multiple array modules, and the array modules can be grouped together to form the transmitter 202. In particular embodiments, each power amplifier can provide wireless signals having one watt of power, seven power amplifiers can be combined into 7 W sub-modules, and sixteen sub-modules can be arranged in 100 W or 112 W four-by-four array modules. Sixty-four of the array modules can be attached in an eight-by-eight array to form a transmitter 202 configured to transmit wireless signals having over 6.4 kW of power or over 7.1 kW of power.

A transmitter controller 204 controls the operation of the transmitter 202 and can denote an "array" controller if the transmitter 202 is implemented as an array (although other embodiments could be used). The transmitter controller 204 can control the operation of the transmitter 202 in any suitable manner. For example, the transmitter controller 204 can control when the transmitter 202 is operating and the pattern of wireless signals being transmitted (which could control the pattern of thermal radiation that the transmitter 202 creates by heating objects). As a particular example, the transmitter controller 204 could control the voltage and current of direct current (DC) power provided to each transmitter element in a transmitter array.

The transmitter controller 204 includes any suitable structure for controlling the operation of a transmitter, such as one or more processing devices. Example types of processing devices include microprocessors, microcontrollers, digital signal processors (DSPs), application specific integrated circuits (ASICs), field programmable gate arrays (FPGAs), and discrete circuitry.

The transmitter controller 204 in this example operates to control a power supply 206, which provides power to the transmitter 202. The power supply 206 here could denote a DC/DC power supply, which converts one form of DC power to another form of DC power. However, any other suitable source of power for the transmitter 202 could be used. Also, the transmitter controller 204 can control any suitable aspects of the power supply 206 in order to control operation of the transmitter 202. For instance, the transmitter controller 204 could control the voltage or current output by the power supply 206 to the transmitter 202 or multiple voltages or currents output by the power supply 206 to individual elements of the transmitter 202.

In this example, the power received at the power supply 206 is obtained from a power distribution unit (PDU) 208, which distributes power from a power supply 210. The power distribution unit 208 and the power supply 210 could denote components in the electronics assembly 106. The power distribution unit 208 and the power supply 210 can optionally be used to provide power to the payload assembly 102 and to other components of a vehicle, vessel, building, or other structure on or to which the system 100 is mounted.

The power distribution unit 208 denotes any suitable structure for distributing power to other components of the system. The power supply 210 includes any suitable source of power. In some embodiments, the power supply 210 is implemented using a pack of high-voltage lithium ion batteries. However, any other suitable source of power for the system 100 could be used, such as one or more supercapacitors.

A system control unit (SCU) 212 in the electronics assembly 106 controls the overall operation of the system 100. For example, the system control unit 212 could receive user input through one or more operator controls 214, and the system control unit 212 could control other components of the system 100 to perform a requested function. As particular examples, the user input could request that the gimbal 104 rotate the payload assembly 102 in order to aim the transmitter 202 in a desired direction or at a desired area, or the user input could request that the system 100 create thermal radiation in a background (possibly using a pattern). The system control unit 212 could control the transmitter controller 204 so that the transmitter 202 transmits the desired wireless signals to heat desired objects and the objects create the desired thermal radiation. The system control unit 212 could also receive input from the one or more targeting sensors 108, which could be used by an operator during the day or at night to locate specific targets or areas.

The system control unit 212 includes any suitable structure for controlling the operation of the system 100, such as one or more processing devices like one or more microprocessors, microcontrollers, DSPs, ASICs, FPGAs, or discrete circuitry. The operator controls 214 include any suitable structure for providing user input, such as a keyboard, keypad, mouse, trackpad, pointer, buttons, or joystick. In some embodiments, the operator controls 214 include a display that presents images to an operator (such as from one or more targeting sensors 108) and a joystick that receives user input from the operator. The joystick could provide (i) movement inputs identifying how the gimbal 104 should rotate the payload assembly 102 and (ii) button inputs identifying when the payload assembly 102 should transmit and stop transmitting wireless signals.

Cooling for the transmitter 202 or other components of the system 100 is provided by coolant, which is stored in a reservoir 216 and moved through the transmitter 202 or other components by a pump 218. The transmitter 202 could be cooled to maintain its performance by allowing the coolant to flow through pipes or other structures that run through to the aperture and transmitter array. The reservoir 216 includes any suitable structure for holding a coolant.

The pump 218 includes any suitable structure for circulating a coolant through a transmitter or other component(s) to be cooled.

One or more generators 220 are used here to provide operating power to other components of the system 100. For example, a generator 220 could be used to provide power to a power supply charger 222, which uses the power to charge or recharge the power supply 210. As another example, a generator 220 could be used to provide power to a chiller 224, which uses the power to cool the coolant being used for thermal management of the transmitter 202 or other components of the system 100. In this example, the coolant could travel from the reservoir 216 to the chiller 224, although the chiller 224 could be used in another location in the coolant loop, in the reservoir 216, or in any other suitable manner.

Each generator 220 includes any suitable structure for generating electrical power for the system 100 and optionally for other components of a vehicle, vessel, building, or other structure on or to which the system 100 is mounted. Note that while multiple generators 220 are shown here, any other suitable number of generators (including a single generator) could be used. In some embodiments, the generators 220 could operate continuously so that the system 100 can operate in continuous or near-continuous mode. In other embodiments, the system 100 could operate intermittently, and the generators 220 could operate to charge or recharge the power supply 210 and cool the coolant at times when the transmitter 202 is not actively transmitting. The coolant used in the system 100 includes any suitable fluid (liquid or gas) for transporting heat away from the transmitter 202 or other components of the system 100, such as poly-alpha-olefin (PAO) or an antifreeze/water mixture. The chiller 224 includes any suitable structure for removing heat from and cooling a fluid, such as a thermoelectric cooler.

The system 100 generally operates by controlling the transmitter 202 to heat objects in random, semi-random, or other shapes in a scene of a large area so that the objects re-radiate infrared/thermal energy (blackbody radiation) that is multi-spectral and covert. Patterning the background in camouflage thermal shapes can help to reduce edge effects and add unique features that can substantially blur infrared images from an onlooker's camera. Moreover, false shapes can be painted with the transmitter 202, such as those that look like soldiers or vehicles, in different locations to create false alarms. As a particular use, a large scene could be heated using the transmitter 202 before personnel arrive, and the thermal background can be allowed to settle naturally to a high contrast, which acts like visual camouflage with degraded visibility. The same techniques can be used to identify a path for personnel at night, create an infrared scene projection in order to test infrared devices, provide static or dynamic virtual scenes for integration and testing, or for other uses.

In some embodiments, the system 100 includes adequate power and coolant to enable prolonged transmission of wireless signals from the transmitter 202 (referred to as a "firing" of the system 100). For example, the system 100 could include enough power in the power supply 210 and enough coolant in the coolant loop to permit the system 100 to transmit wireless signals for up to about 100 seconds. Once each firing of the system 100 is completed, the power supply 210 can be recharged and the chiller 224 can cool the coolant in order to prepare the system 100 for the next firing.

Note that the system 100 could be used at any suitable distance to create the thermal radiation in a desired area. In some instances, the system 100 could be configured to create thermal radiation in an area that is between one hundred meters to several kilometers away from the system 100. The distance at which the system 100 is used from the area in which the thermal radiation is being created is referred to as a "standoff" distance. Different standoff distances can be achieved by varying the power of the wireless signals transmitted from the system 100, such as by varying the number of transmitter elements, sub-modules, or modules installed or used in the transmitter 202. In some cases, the number of active transmitter elements, sub-modules, or modules in the transmitter 202 can be controlled so that the transmitter 202 can be used to create thermal emissions at different distances.

Also note that it is often assumed here that the pattern of thermal radiation created by the system 100 through illumination with wireless signals from the transmitter 202 in the system 100 is based on the control of the transmitter 202. However, this need not be the case. For example, the transmitter 202 in the system 100 could be designed to create a fixed pattern of thermal radiation in a given area. As a specific example, a millimeter wave, microwave, terahertz, or high-energy laser source could be designed or patterned to illuminate a given area in a fixed way, such as by using a constant transmission power. In these embodiments, the transmitter controller 204 could control whether the transmitter 202 is transmitting but not the specific pattern of the transmission. Ideally, the illumination still causes objects in the given area to radiate thermal energy in a desired manner and interfere with infrared cameras or other infrared detectors viewing the given area.

Although FIG. 2 illustrates examples of components of an active multi-spectral system 100 for generating camouflage or other radiating patterns in a scene, various changes may be made to FIG. 2. For example, various components in FIG. 2 could be combined, further subdivided, rearranged, or omitted and additional components could be added according to particular needs. As a particular example, the transmitter controller 204 and the system control unit 212 could be combined into one or more common processing devices or other control devices. Also, while the description of FIG. 2 provides specific implementations for various components (such as an eight-by-eight transmitter array or a lithium ion battery pack), other components could be used in the system 100.

Figure 3:
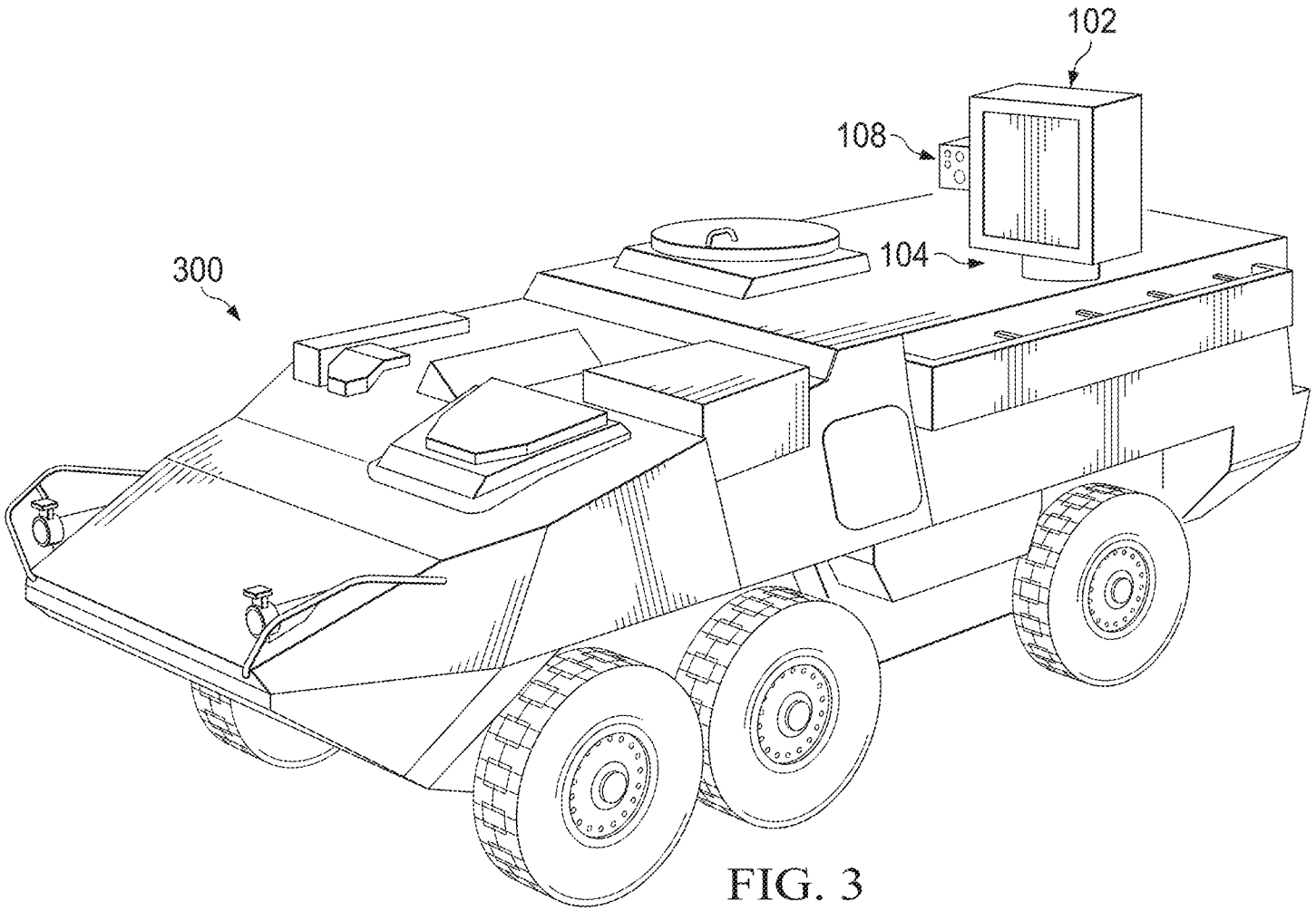
FIG. 3 illustrates an example vehicle using an active multi-spectral system for generating camouflage or other radiating patterns in a scene in accordance with this disclosure.

FIG. 3 illustrates an example vehicle 300 using an active multi-spectral system 100 for generating camouflage or other radiating patterns in a scene in accordance with this disclosure. The embodiment of the vehicle 300 shown in FIG. 3 is for illustration only. Other embodiments of the vehicle 300 could be used without departing from the scope of this disclosure.

As shown in FIG. 3, the vehicle 300 generally represents an armored vehicle that can be used to transport personnel and equipment (including the system 100). The vehicle 300 need not be dedicated to transporting the system 100 and could be used for other purposes. Note that the armored vehicle could have any suitable form and need not represent the specific vehicle 300 shown in FIG. 3. Also note that the system 100 could be mounted on any other suitable vehicle, vessel, or other support structure, such as a building.

As can be seen here, the form factor of the system 100 in FIG. 3 is different from the form factor of the system 100 shown in FIG. 1. In particular, the one or more targeting sensors 108 are positioned on a side of the payload assembly 102 or on a side of the gimbal 104, rather than on top of the payload assembly 102. However, the one or more targeting sensors 108 can still operate as described above to provide information to an operator, such as visible or infrared images or laser rangefinder distances. Also, the gimbal 104 shown here has a different form but can still operate to rotate the payload assembly 102 about multiple axes or otherwise point the payload assembly 102 in one or more desired directions.

The active multi-spectral system 100 here is mounted on or to the top of the vehicle 300, and the payload assembly 102 can be easily rotated by the gimbal 104 to point in one or more desired directions. The payload assembly 102 then operates as described above to generate wireless signals that heat objects, causing the objects to produce thermal emissions and radiate thermal energy. The thermal radiation can interfere with infrared cameras or other infrared detectors viewing the objects, create temporary infrared markers, or perform other functions.

Although FIG. 3 illustrates one example of a vehicle 300 using an active multi-spectral system 100 for generating camouflage or other radiating patterns in a scene, various changes may be made to FIG. 3. For example, the active multi-spectral system 100 can be mounted to any other support structure and can be used in any other suitable manner. Other example types of structures that could be used with the active multi-spectral system 100 include ships, planes, or other vehicles. When used with ships, for instance, the active multi-spectral system 100 could be used to heat surface vegetation to create the thermal appearance of multiple ships.

Figure 4:
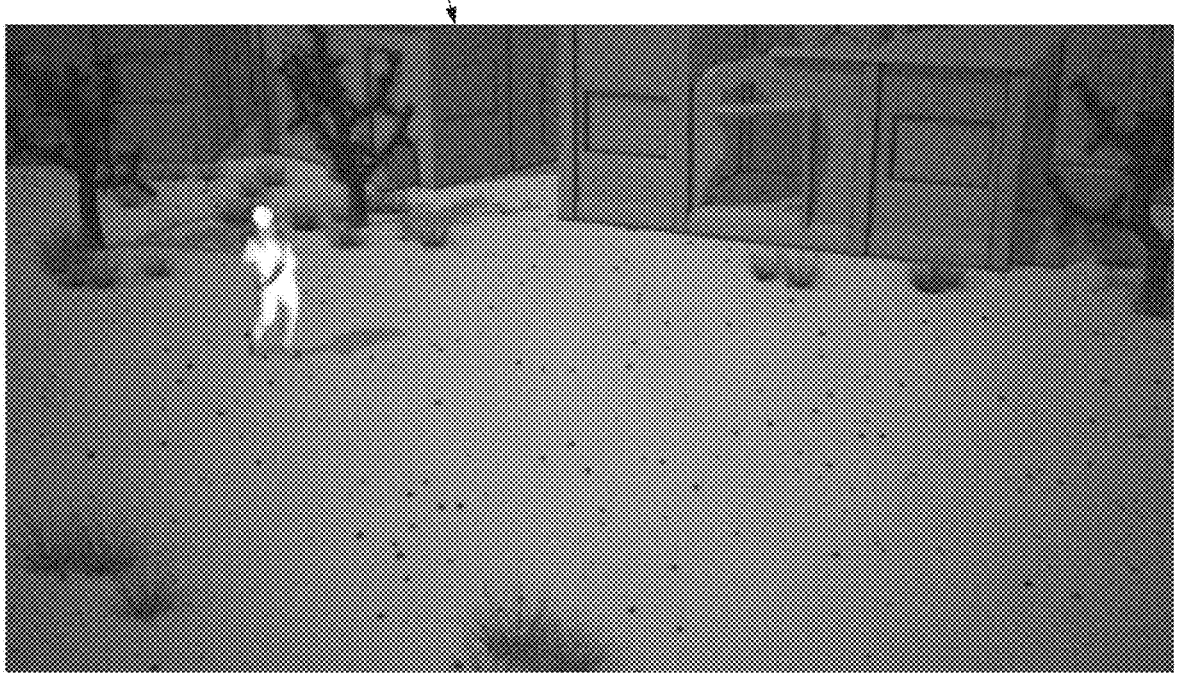
FIGS. 4 and 5 illustrate example results obtained using an active multi-spectral system for generating camouflage or other radiating patterns in a scene in accordance with this disclosure.
Figure 5:
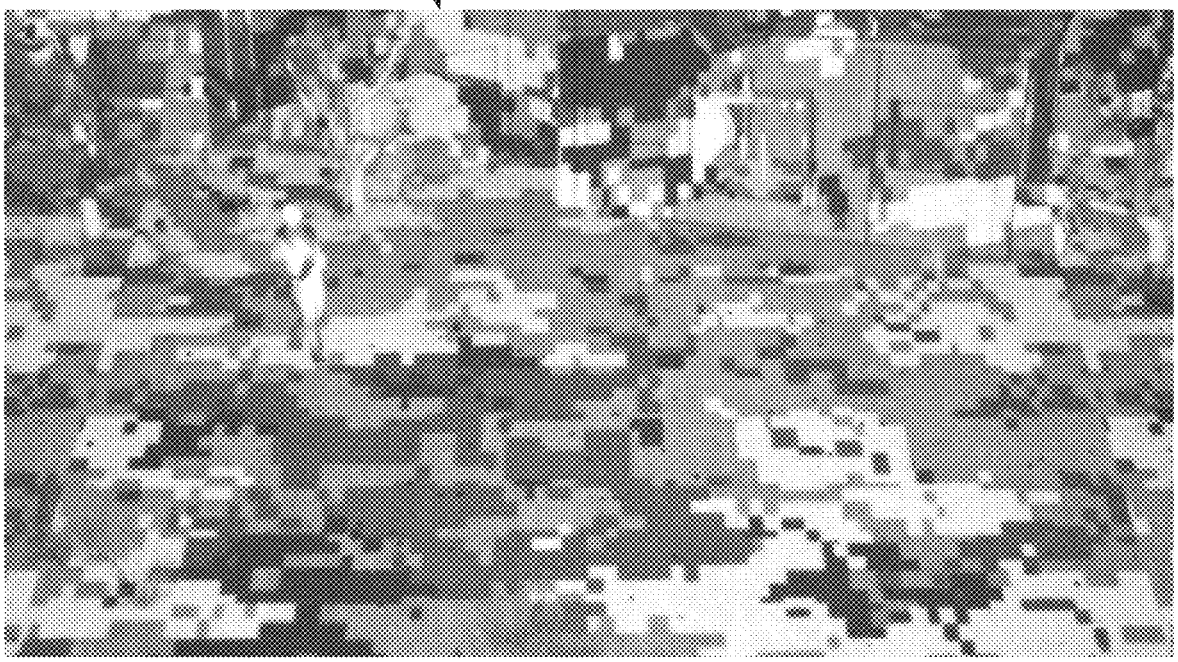

FIGS. 4 and 5 illustrate example results obtained using an active multi-spectral system 100 for generating camouflage or other radiating patterns in a scene in accordance with this disclosure. For ease of explanation, the example results shown here are described as being obtained using the system 100 of FIGS. 1 and 2 for a specific scene. However, other results could be obtained using the system 100, and similar or different results could be obtained using other systems depending on the implementation and the infrared scene being illuminated or viewed.

FIG. 4 illustrates an infrared image 400 of an area without background heating. As can be seen here, the background is generally defined using darker colors, which is typically due to the fact that many objects in the background are at or near the same temperature or are within a similar range of temperatures (in the infrared spectrum). However, the heat from a person is much brighter and is clearly visible in the infrared image 400. As noted above, this is because a person is typically hundreds of degrees hotter than a background's cold temperature in the infrared spectrum. Thus, the person is easily spotted in the image 400.

FIG. 5 illustrates an infrared image 500 of the same area with background heating employed. As can be seen here, the background is now much more cluttered due to the radiating of thermal energy created by the wireless signals transmitted from the transmitter 202 in the system 100. The pattern of thermal radiation created by the transmitter 202 causes some areas of the background to heat near, to, or above the temperature of the person in the infrared image 500. Thus, the heat from the person is much harder to see in the infrared image 500. Even better results could be obtained by altering the pattern of thermal radiation, and dynamic changes to the pattern of thermal radiation could also be used to help mask movement of the person. If desired, feedback from the targeting sensors 108 (such as an infrared camera) could be used to sense the actual thermal emissions from the background, and the wireless signals transmitted from the transmitter 202 can be varied to create improved thermal emissions.

Although FIGS. 4 and 5 illustrate examples of results obtained using an active multi-spectral system 100 for generating camouflage or other radiating patterns in a scene, various changes may be made to FIGS. 4 and 5. For example, this is one example use of the system 100. Other uses are also possible, such as obscuring, concealing, or otherwise camouflaging vehicles or other objects, creating temporary infrared markers, or infrared scene projection during integration or testing.

Figure 6:
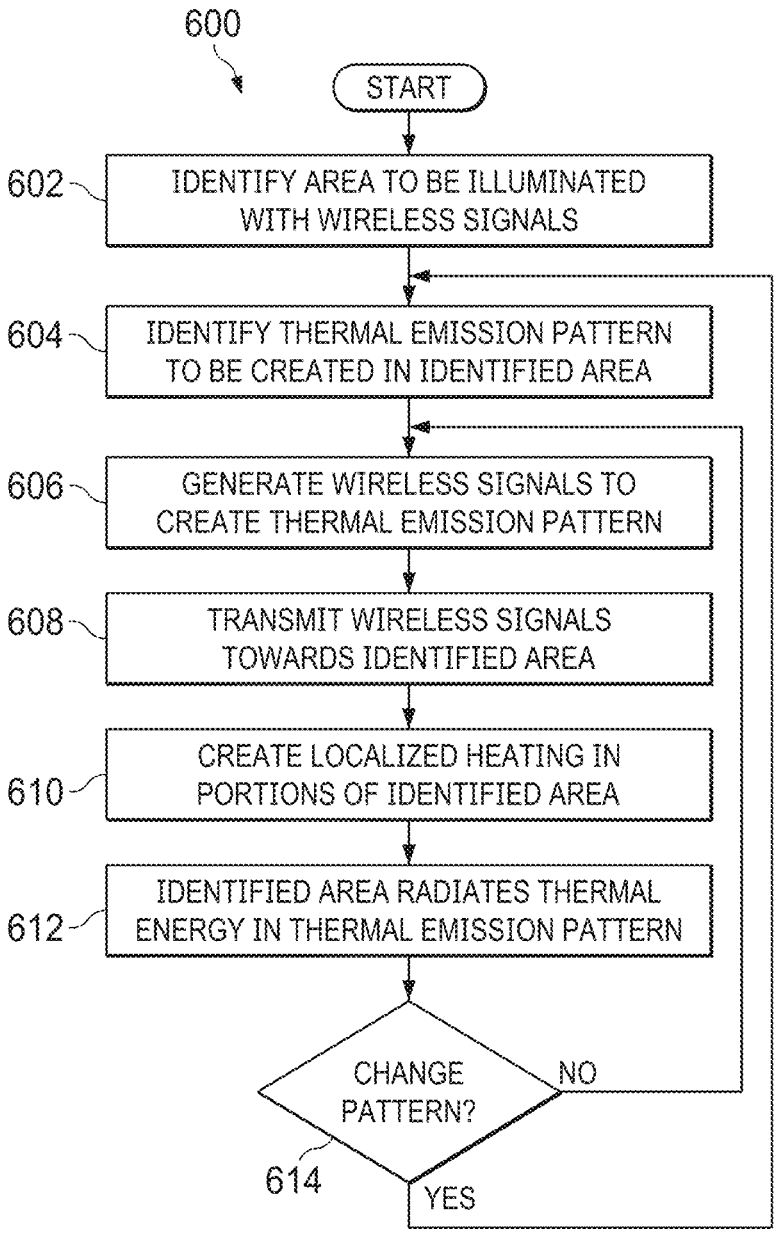
FIG. 6 illustrates an example method for generating camouflage or other radiating patterns in a scene using an active multi-spectral system in accordance with this disclosure.

FIG. 6 illustrates an example method 600 for generating camouflage or other radiating patterns in a scene using an active multi-spectral system in accordance with this disclosure. The embodiment of the method 600 shown in FIG. 6 is for illustration only. Other embodiments of the method 600 could be used without departing from the scope of this disclosure. For ease of explanation, the method 600 is described as being performed using the system 100 of FIGS. 1 and 2. However, the method 600 could be performed using any other suitable device or system.

As shown in FIG. 6, an area to be illuminated with wireless signals is identified at step 602. This could include, for example, an operator using one or more operator controls 214 to point the payload assembly 102 in a desired direction. One or more targeting sensors 108 (such as a visible camera or infrared camera) could be used to present images to the operator so that the operator can point the payload assembly 102 in the desired direction.

A thermal emission pattern to be created in the area is identified at step 604. This could include, for example, an operator using one or more operator controls 214 to identify the type of thermal emission pattern to be created in the identified area. As described above, the system 100 could be used in various ways, such as to generate a camouflage pattern that increases clutter in an infrared image of the identified area, at least one temporary infrared marker in the identified area, or at least one false shape in an infrared image of the identified area. A camouflage pattern could be used to obscure or conceal one or more people, animals, or objects in the infrared image. A temporary infrared marker could be used to identify a path through a terrain or to provide a "friend or foe" identification. A false shape could be used to create a decoy in the infrared image. As noted above, however, step 604 may be optional in those cases where the transmitter 202 of the system 100 is designed to use constant transmission power or to transmit wireless signals that create a fixed pattern of thermal emissions in the background.

Wireless signals are generated based on the identified pattern at step 606 and transmitted towards the identified area at step 608. This could include, for example, the transmitter 202 generating microwave, millimeter wave, terahertz, high-energy laser, or other wireless signals. This could also include the transmitter 202 transmitting the microwave, millimeter wave, terahertz, high-energy laser, or other wireless signals towards natural objects (such as plants, rocks, and dirt) in the identified area and towards manmade objects (such as vehicles and structures) in the identified area.

The wireless signals create localized heating in portions of the identified area at step 610. This could include, for example, the objects in the identified area absorbing the wireless signals. This could also include the absorbed wireless signals heating the objects in different ways so that the objects are heated non-uniformly. In some cases, the differences in localized heating can be caused by different water or other moisture/liquid content in the objects. The identified area radiates thermal energy in the thermal emission pattern at step 612. This could include, for example, the objects radiating thermal energy after being heated by the wireless signals.

If desired, a determination can be made whether to change the thermal emission pattern at step 614. This could include, for example, the transmitter controller 204 or the system control unit 212 determining whether a dynamic pattern of thermal emissions is to be created in the identified area. This may or may not be based on feedback from an infrared camera or other targeting sensor 108. A dynamic pattern of thermal emissions could be useful, for instance, to mask the movements of one or more targets in the identified area. If not, the process can return to step 606 to continue generating and transmitting wireless signals, although at some point the process ends (such as after a specified amount of time has passed or a specified level of heating has been achieved). Otherwise, the process returns to step 604 to select another thermal emission pattern to be created.

Although FIG. 6 illustrates one example of a method 600 for generating camouflage or other radiating patterns in a scene using an active multi-spectral system, various changes may be made to FIG. 6. For example, while shown as a series of steps, various steps in FIG. 6 can overlap, occur in parallel, occur in a different order, or occur any number of times.

In some embodiments, various functions described in this patent document are implemented or supported by a computer program that is formed from computer readable program code and that is embodied in a computer readable medium. The phrase "computer readable program code" includes any type of computer code, including source code, object code, and executable code. The phrase "computer readable medium" includes any type of medium capable of being accessed by a computer, such as read only memory (ROM), random access memory (RAM), a hard disk drive, a compact disc (CD), a digital video disc (DVD), or any other type of memory. A "non-transitory" computer readable medium excludes wired, wireless, optical, or other communication links that transport transitory electrical or other signals. A non-transitory computer readable medium includes media where data can be permanently stored and media where data can be stored and later overwritten, such as a rewritable optical disc or an erasable memory device.

It may be advantageous to set forth definitions of certain words and phrases used throughout this patent document. The terms "application" and "program" refer to one or more computer programs, software components, sets of instructions, procedures, functions, objects, classes, instances, related data, or a portion thereof adapted for implementation in a suitable computer code (including source code, object code, or executable code). The term "communicate," as well as derivatives thereof, encompasses both direct and indirect communication. The terms "include" and "comprise," as well as derivatives thereof, mean inclusion without limitation. The term "or" is inclusive, meaning and/or. The phrase "associated with," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, have a relationship to or with, or the like. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C.

The description in the present application should not be read as implying that any particular element, step, or function is an essential or critical element that must be included in the claim scope. The scope of patented subject matter is defined only by the allowed claims. Moreover, none of the claims is intended to invoke 35 U.S.C. § 202(f) with respect to any of the appended claims or claim elements unless the exact words "means for" or "step for" are explicitly used in the particular claim, followed by a participle phrase identifying a function. Use of terms such as (but not limited to) "mechanism," "module," "device," "unit," "component," "element," "member," "apparatus," "machine," "system," "processor," or "controller" within a claim is understood and intended to refer to structures known to those skilled in the relevant art, as further modified or enhanced by the features of the claims themselves, and is not intended to invoke 35 U.S.C. § 202(f).

While this disclosure has described certain embodiments and generally associated methods, alterations and permutations of these embodiments and methods will be apparent to those skilled in the art. Accordingly, the above description of example embodiments does not define or constrain this disclosure. Other changes, substitutions, and alterations are also possible without departing from the scope of this disclosure, as defined by the following claims.

What is claimed is:

1. An apparatus comprising:

at least one transmitter configured to transmit wireless signals that create different localized heating in different portions of a scene, the different localized heating in the different portions of the scene based on different moisture or liquid content within objects in the scene; and at least one controller configured to control the at least one transmitter in order to control the different localized heating in the different portions of the scene and to create a desired thermal radiation pattern in the scene;

wherein the desired thermal radiation pattern in the scene comprises a camouflage pattern that increases clutter in an infrared image of the scene.

2. The apparatus of claim 1, wherein the camouflage pattern is configured to obscure or conceal one or more targets in the infrared image.

3. The apparatus of claim 1, wherein the at least one transmitter comprises at least one of: a microwave transmitter, a millimeter wave transmitter, a terahertz transmitter, and a high-energy laser.

4. The apparatus of claim 1, wherein the at least one transmitter is configured to cause plants, rocks, and dirt in the scene to radiate thermal energy.

5. An apparatus comprising:

at least one transmitter configured to transmit wireless signals that create different localized heating in different portions of a scene, the different localized heating in the different portions of the scene based on different moisture or liquid content within objects in the scene; and at least one controller configured to control the at least one transmitter in order to control the different localized heating in the different portions of the scene and to create a desired thermal radiation pattern in the scene;

wherein the desired thermal radiation pattern in the scene forms at least one false shape in an infrared image of the scene.

6. An apparatus comprising:

at least one transmitter configured to transmit wireless signals that create different localized heating in different portions of a scene, the different localized heating in the different portions of the scene based on different moisture or liquid content within objects in the scene; and at least one controller configured to control the at least one transmitter in order to control the different localized heating in the different portions of the scene and to create a desired dynamic thermal radiation pattern in the scene.

7. The apparatus of claim 6, wherein the desired thermal radiation pattern in the scene comprises at least one temporary infrared marker.

8. An apparatus comprising:

at least one transmitter configured to transmit wireless signals that create different localized heating in different portions of a scene, the different localized heating in the different portions of the scene based on different moisture or liquid content within objects in the scene; and at least one controller configured to control the at least one transmitter in order to control the different localized heating in the different portions of the scene and to create a desired thermal radiation pattern in the scene;

wherein the desired thermal radiation pattern in the scene reduces a contrast between a cold infrared background in the scene and one or more targets in the scene.

9. The apparatus of claim 8, wherein the desired thermal radiation pattern in the scene comprises a camouflage pattern that increases clutter in an infrared image of the scene.

10. A method comprising:

using at least one transmitter, transmitting wireless signals that create different localized heating in different portions of a scene, the different localized heating in the different portions of the scene based on different moisture or liquid content within objects in the scene; and controlling the at least one transmitter in order to control the different localized heating in the different portions of the scene and to create a desired thermal radiation pattern in the scene;

wherein the desired thermal radiation pattern in the scene forms at least one false shape in an infrared image of the scene.

11. The method of claim 10, wherein the desired thermal radiation pattern in the scene comprises at least one temporary infrared marker.

12. The method of claim 10, wherein transmitting the wireless signals comprises transmitting the wireless signals using a constant transmission pattern.

13. The method of claim 10, wherein the wireless signals cause plants, rocks, and dirt in the scene to radiate thermal energy.

14. A method comprising:

using at least one transmitter, transmitting wireless signals that create different localized heating in different portions of a scene, the different localized heating in the different portions of the scene based on different moisture or liquid content within objects in the scene; and controlling the at least one transmitter in order to control the different localized heating in the different portions of the scene and to create a desired thermal radiation pattern in the scene;

wherein the desired thermal radiation pattern in the scene comprises a camouflage pattern that increases clutter in an infrared image of the scene.

15. The method of claim 14, wherein the camouflage pattern is configured to obscure or conceal one or more targets in the infrared image.

16. A method comprising:

using at least one transmitter, transmitting wireless signals that create different localized heating in different portions of a scene, the different localized heating in the different portions of the scene based on different moisture or liquid content within objects in the scene; and controlling the at least one transmitter in order to control the different localized heating in the different portions of the scene and to create a desired dynamic thermal radiation pattern in the scene.

17. The method of claim 16, wherein the desired thermal radiation pattern in the scene forms at least one false shape in an infrared image of the scene.

18. A method comprising:

using at least one transmitter, transmitting wireless signals that create different localized heating in different portions of a scene, the different localized heating in the different portions of the scene based on different moisture or liquid content within objects in the scene; and controlling the at least one transmitter in order to control the different localized heating in the different portions of the scene and to create a desired thermal radiation pattern in the scene;

wherein the desired thermal radiation pattern in the scene reduces a contrast between a cold infrared background in the scene and one or more targets in the scene.

19. A non-transitory computer readable medium containing instructions that when executed cause at least one processing device to:

initiate transmission, by at least one transmitter, of wireless signals that create different localized heating in different portions of a scene, the different localized heating in the different portions of the scene based on different moisture or liquid content within objects in the scene; and control the at least one transmitter in order to control the different localized heating in the different portions of the scene and to create a desired thermal radiation pattern in the scene;

wherein the desired thermal radiation pattern in the scene comprises a camouflage pattern that increases clutter in an infrared image of the scene.

20. The non-transitory computer readable medium of claim 19, further containing instructions that when executed cause the at least one processing device to:

control the at least one transmitter in order to create at least one temporary infrared marker.

* * * * *